US006893382B1

(12) United States Patent
Moon et al.

(10) Patent No.: US 6,893,382 B1
(45) Date of Patent: May 17, 2005

(54) DUAL MOTION ARM POWERED TREADMILL

(75) Inventors: Dan Moon, Riverside, IL (US); Stanley Goldfader, St. Louis, MO (US)

(73) Assignee: True Fitness Technology, Inc., O'Fallon, MO (US)

( * ) Notice: Subject to any disclaimer, the term of this patent is extended or adjusted under 35 U.S.C. 154(b) by 0 days.

(21) Appl. No.: 09/545,373

(22) Filed: Apr. 7, 2000

Related U.S. Application Data

(63) Continuation-in-part of application No. 09/252,753, filed on Feb. 19, 1999, now abandoned.

(51) Int. Cl.[7] ..... A63B 22/02
(52) U.S. Cl. ..... 482/54; 482/51
(58) Field of Search ..... 482/37, 51–54, 482/70

(56) References Cited

U.S. PATENT DOCUMENTS

| | | | | |
|---|---|---|---|---|
| 1,211,765 | A | | 1/1917 | Schmidt |
| 3,216,722 | A | | 11/1965 | Odom |
| 4,188,030 | A | | 2/1980 | Hooper |
| 4,313,603 | A | | 2/1982 | Simjian |
| 4,512,571 | A | | 4/1985 | Hermelin |
| 4,529,195 | A | | 7/1985 | Stevens |
| 4,632,385 | A | | 12/1986 | Geraci |
| 4,712,790 | A | | 12/1987 | Szymski |
| 4,869,494 | A | | 9/1989 | Lambert, Sr. |
| 4,880,225 | A | | 11/1989 | Lucas et al. |
| 4,911,425 | A | | 3/1990 | Kynast et al. |
| 4,960,276 | A | | 10/1990 | Feuer et al. |
| 4,966,362 | A | | 10/1990 | Ramaekers |
| 4,979,731 | A | | 12/1990 | Hermelin |
| 4,986,533 | A | | 1/1991 | Lo |
| 5,058,888 | A | | 10/1991 | Walker et al. |
| 5,110,117 | A | | 5/1992 | Fisher et al. |
| 5,192,257 | A | | 3/1993 | Panasewicz |
| 5,209,715 | A | | 5/1993 | Walker et al. |
| 5,226,866 | A | | 7/1993 | Engel et al. |
| RE34,478 | E | | 12/1993 | Dalebout et al. |
| 5,318,491 | A | | 6/1994 | Houston |
| 5,403,255 | A | | 4/1995 | Johnston |
| 5,411,455 | A | * | 5/1995 | Haber et al. ..... 482/54 |
| 5,447,479 | A | | 9/1995 | Gvoich |
| 5,688,209 | A | | 11/1997 | Trulaske et al. |
| 5,871,421 | A | | 2/1999 | Trulaske et al. |

FOREIGN PATENT DOCUMENTS

| | | |
|---|---|---|
| CA | 966865 | 4/1975 |
| GB | 395334 | of 1908 |
| TW | 235488 | 12/1994 |

* cited by examiner

*Primary Examiner*—Glenn E. Richman
(74) *Attorney, Agent, or Firm*—Lewis, Rice & Fingersh, LC

(57) ABSTRACT

A motorless treadmill is disclosed which exercises the upper body and lower body of a user. Displacement of an upper-body exercise mechanism such as a pair of reciprocating arm members rotates a drive roller, which is coupled to an endless belt through a transmission system. The transmission system employs a double-wound belt, which links the drive roller to the upper body exercise mechanism such that arm movements are translated into belt rotation. The double-wound belt allows for arm motion in both directions to directly drive the belt, through the use of one-way clutches orientated in opposite directions on the drive shaft. Further, the double-wound belt transmission system allows independent operation of each arm. A flywheel may be added to store energy to smooth the belt rotation.

18 Claims, 8 Drawing Sheets

DUAL MOTION ARM POWERED TREADMILL

CROSS REFERENCE TO RELATED APPLICATIONS

This application is a continuation-in-part of, and claims priority to, U.S. patent application Ser. No. 09/252,753 filed Feb. 19, 1999, now abandoned, the entire disclosure of which is herein incorporated by reference. Now abandoned.

BACKGROUND OF THE INVENTION

1. Field of the Invention

The invention relates generally to exercise equipment, and more particularly to a treadmill for exercising the upper and lower body of a user. More specifically, the present invention relates to a motorless treadmill powered by arm members that move at rates independent of each other.

2. Prior Art

Treadmills for providing a striding or walking exercise surface are well known in the art. Conventional treadmills employ a motor to rearwardly drive an endless belt as a user maintains a striding motion on the exercise surface. Generally, the user of a conventional treadmill is able to vary the speed and incline of the treadmill to obtain a desired level of workout. More sophisticated treadmills, such as described in U.S. Pat. No. 5,462,504 and assigned to the assignee of the present application, automatically adjust the speed and incline of the treadmill to control the heart rate of the user during exercise.

In general, treadmills function to exercise the user's cardiovascular system and the skeletal muscles of the lower body, but do not exercise the upper body to any significant extent. Accordingly, a number of treadmills have an upper body exercise means, such as upstanding arm members, which are moveable by the user against the resistance of a spring or friction brake.

While conventional motor-driven treadmills provide a desirable exercise apparatus in appropriate settings, in other settings the motor makes such an apparatus undesirable. For example, motors used in treadmills need maintenance, can fail, require a power source and add to the overall weight of the treadmill. Finally, motor-driven treadmills are more expensive to purchase relative to motorless treadmills. As a result, manual treadmills are known in the art which do not use motors, but instead are designed to be inclined such that the belt rotates rearwardly as a result of the weight and forward striding action of the user overcoming belt friction. In these types of treadmills it is important for the treadmill surface to maintain a certain minimum level of incline to power the belt rearwardly by the weight of the user exerting a force downward upon the inclined plane of the treadmill. However, such a steep incline of the treadmill surface feels unnatural to the user, and is not at all like the user's normal walking motion.

More sophisticated manual treadmills, such as the manual treadmill described in U.S. Pat. No. 5,688,209 and assigned to the assignee to the present application, use the motion of the user's arms through movement of arm members linked to the treadmill to power the belt in a rearward direction. However, the right arm member of the treadmill disclosed in the patent is reciprocally linked to the left arm member requiring both arm members to move at the same rate to provide the desired rearward movement of the belt. Only moving a single arm member in either the forward or rearward direction will cause the belt to move rearwardly. However, due to the interlinked relationship of the arm members, both arm members must move at the same rate and in the opposite directions of one another, which may not be the preference of the user. Therefore, there exists a need in the art for a manual treadmill that includes arm members that power the belt at rates independent of each other such that operation of one arm member in either reciprocating direction powers the belt.

SUMMARY OF THE INVENTION

Accordingly, it is an object of the present invention to provide a manual treadmill that exercises the upper and lower body of a user such that the user can power the belt of the treadmill rearwardly through movement of the arm members at rates independent of each arm member.

It is another object of the present invention to provide a manual treadmill having arm members that power the tread belt regardless of the direction of the respective arm member.

It is another further object to provide a manual treadmill wherein the power provided by the upper body of a user allows the incline of the treadmill exercise surface to be at a much shallower, more natural walking angle of the user.

Another object is to provide a treadmill as characterized above which is relatively uncomplicated in design and manufacture.

These and other objects of the present invention are realized in the preferred embodiment of the present invention, described by way of example and not be way of limitation, which provides for a manual treadmill for exercising the upper body and lower body of a user, wherein displacement of an upper-body exercise means drives an endless belt to rotate in one direction around the support frame, and wherein a transmission means links the drive roller to the upper body exercise means such that arm movements in both directions are translated into belt rotation.

Additional objects, advantages and novel features of the present invention will be set forth in the description which follows, and will become apparent to those skilled in the art upon examination of the following more detailed description and drawings in which like elements of the invention are similarly numbered throughout.

DETAILED DESCRIPTION OF THE INVENTION

Figure 1:
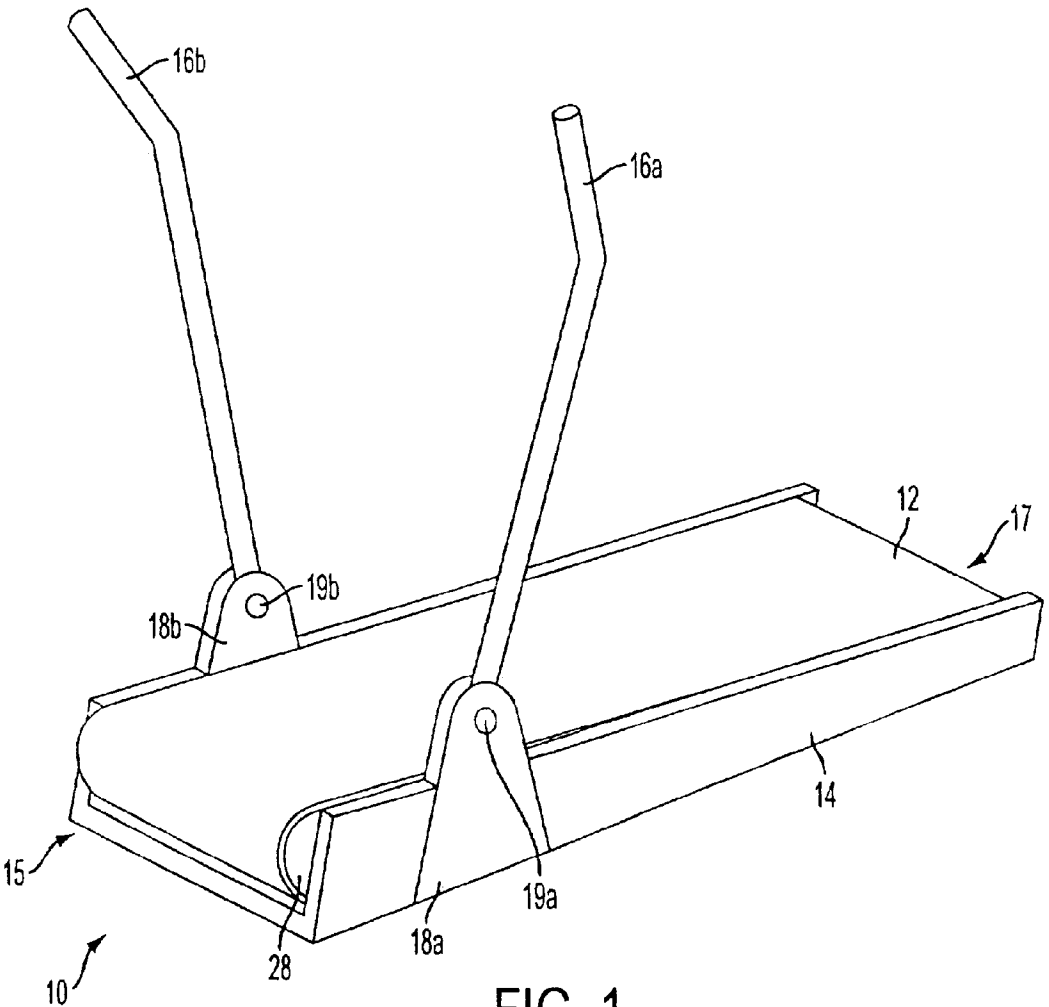
FIG. 1 is a perspective view of a treadmill according to the present invention.
Figure 2A:
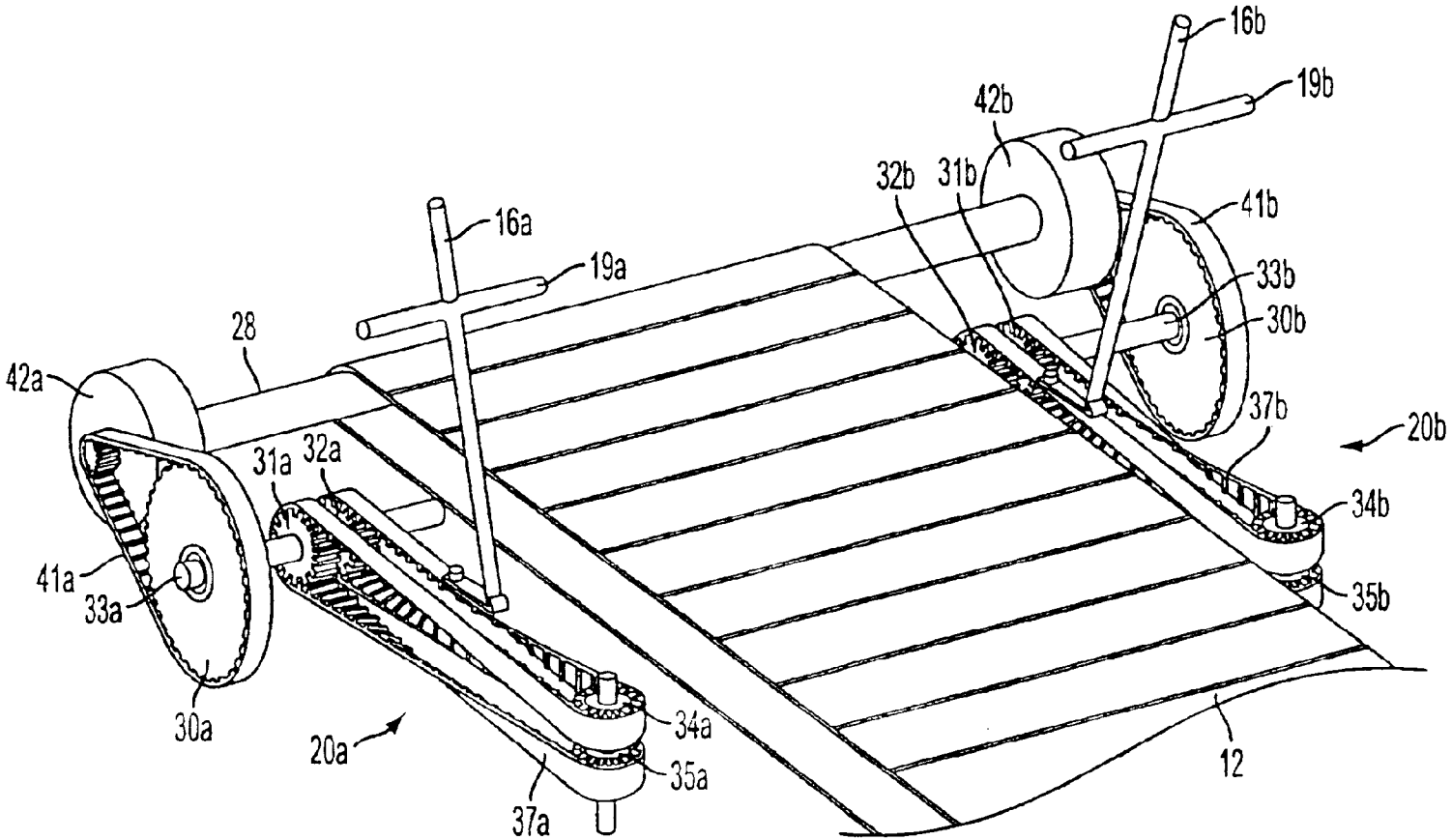
FIG. 2A is a partial perspective view of the treadmill showing the dual motion mechanism connected to a flywheel according to the present invention.
Figure 2B:
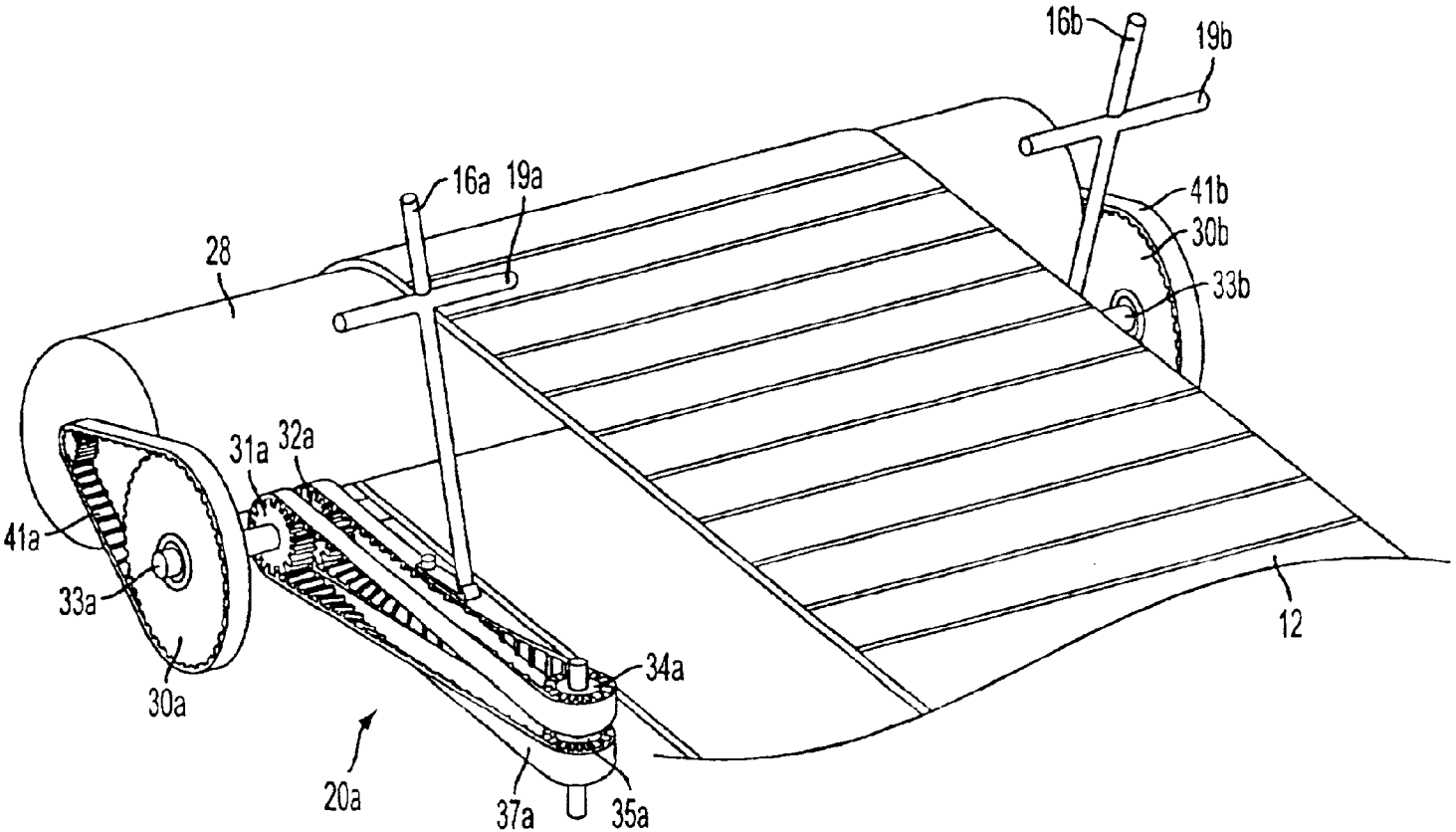
FIG. 2B is a partial perspective view of the treadmill showing the dual motion mechanism connected to a drive roller according to the present invention.

Referring to the drawings, the preferred embodiment of the manual treadmill of the present invention is illustrated and generally indicated as 10 in FIG. 1. As shown in FIGS. 1, 2*a* and 2*b*, treadmill 10 comprises an endless belt 12 riding upon a low-friction support surface (not shown) supported by a base 14. The base 14 is slightly elevated at its forward end 15 with respect to its rearward end 17 such that treadmill 10 is inclined at a relatively shallow angle relative to a level surface. Of course, if desired, treadmill 10 may be arranged such that the incline may be varied by any suitable means, such as by providing manually or automatically adjustable feet or framing members, including pneumatic or hydraulic actuators, or motor-driven incline means. For example, one suitable motor driven elevation means that operates by raising the base of the treadmill with respect to an underlying frame member is described in U.S. Pat. No. 5,462,504, incorporated herein by reference in its entirety.

Treadmill 10 further comprises generally upright left and right arm members 16*a* and 16*b* from the perspective of the user. For ease of reference, components which have a symmetrical counterpart of an opposing side are numbered such that those on the left side are denoted by the lower case letter "a" and those on the right side by the lower case letter "b". Arm members 16*a* and 16*b* are preferably of a length wherein a user can grasp them in a reasonably comfortable position when employing a striding motion on treadmill 10, and such that the user's arms and upper body are exercised by movement of a reciprocating backward and forward motion of members 16*a* and 16*b* without overburdening any particular muscle group. As such, arm members 16*a* and 16*b* may be adjustable in length to accommodate different users. One design for adjusting arm members 16*a* and 16*b* is disclosed in U.S. Pat. No. 5,688,209, assigned to the assignee of the present application, which is incorporated herein by reference in its entirety.

As further shown in FIGS. 1, 2*a* and 2*b*, base 14 supports belt 12 and support surface, and further serves as a protective housing to prevent users from contacting the moving parts of treadmill 10. As such, base 14 includes triangular shaped coverings 18*a* and 18*b* which protect the user from the movement of respective arm members 16*a* and 16*b* below pivot points 19*a* and l9*b* where members 16*a* and 16*b* are pivotally coupled to base 14.

According to one aspect of the invention, as shown in greater detail in FIG. 2*a*, the movement of arm members 16*a* and 16*b* by the user powers a transmission system, generally designated 20*a* and 20*b*, that rotates belt 12 in a rearward direction relative to base 14. To this end, the reciprocating lower ends of arm members 16*a* and 16*b* are operatively attached to respective double wound belts 37*a* and 37*b* which are engaged around respective freewheel pulleys 34*a*, 34*b* and 35*a*, 35*b* and clutches 31*a*, 31*b* and 32*a*, 32*b*. The clutches 31*a* and 32*a* share a common drive shaft 33*a*, while clutches 31*b* and 32*b* share another common drive shaft 33*b*. As further shown, pulley 30*a* is driven by drive shaft 33*a* and pulley 30*b* is similarly driven by drive shaft 33*b*, respectively. Pulleys 30*a* and 30*b* are attached via respective pulley belts 41*a* and 41*b* to flywheels 42*a* and 42*b*. The angular momentum generated by either flywheel 42*a* or 42*b* as it rotates drives the drive roller 28 which rotates the belt 12 rearwardly relative to base 14.

Referring now to the left side of treadmill 10 shown in FIGS. 3 and 4, the operation of the transmission system 20*a* will be discussed in greater detail. The forward and rearward movement of any members 16*a* and 16*b* moves the double wound belt 37*a* which causes clutches 31*a* and 32*a* to rotate in opposite directions relative to each other. The rotation of clutches 31*a* and 32*a* in turn powers drive shaft 33*a* which rotates pulley 30*a*. As pulley 30*a* rotates, pulley belt 41*a* drives flywheel 42*a* which in turn causes drive roller 28 to rotate belt 12. Transmission system 20*b* located on the right side of treadmill 10 has the same configuration and functions in the same manner as the left side of transmission system 20*a*. The present invention contemplates that transmission system 20*a* operates independently of transmission system 20*b* such that operation of either arm member 16*a* or 16*b* rotates the driver roller 28 regardless of the direction that either arm member 16*a* or 16*b* is moving as shall be discussed in greater detail below. Belt 12 may be arranged on treadmill 10 so as not to slip on drive roller 28 by providing a proper tensioning means, coefficients of friction and/or treads formed along the underside of the belt 12 to engage with counterpart treads (not shown) on the drive roller 28. A rear roller 29, as shown in FIG. 5, is provided at the rear portion 17 of treadmill 10 to redirect belt 12 forwardly along the underside of the support surface. As can be appreciated, the actual functions of the rollers 28 and 29 can be reversed, e.g. if desired, rear roller 29 can be mechanically arranged to drive belt 12 while the drive roller 28 functions to redirect belt 12.

According to another aspect of the invention, as shown in FIG. 2*a*, the pulleys 30*a* and 30*b* are attached via respective pulley belts 41*a* and 41*b* to drive roller 28. With respect to transmission system 20*a*, movement of the double wound belt 37*a* when arm member 16*a* is moved in either a forward or backward direction causes clutches 31*a* and 32*a* to rotate in opposite directions. This, in turn, rotates drive shaft 33*a* which drives pulley 30*a*. Pulley 30*a* then directly transfers its rotational energy to the drive roller 28 through movement of pulley belt 41*a*. As noted above, transmission system 20*b* independently operates in the same manner when arm member 16*b* is moved in either a rearward or forward direction.

Figure 3:
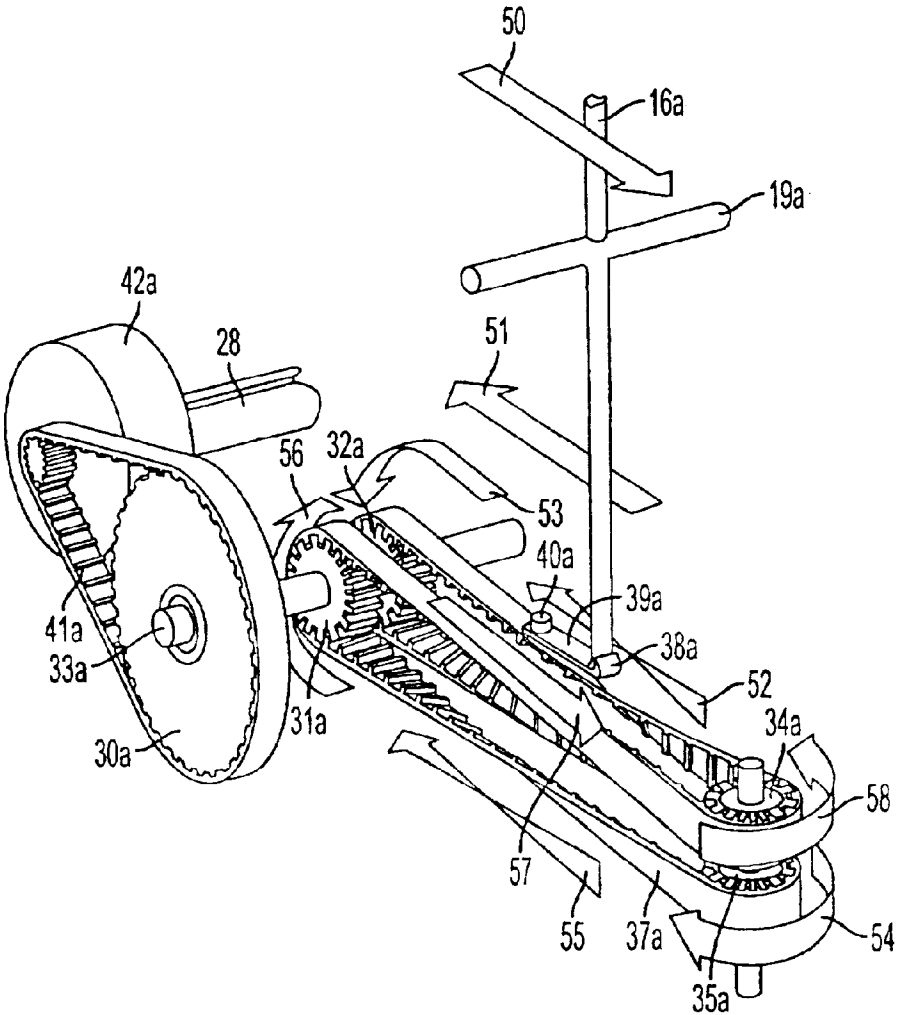
FIG. 3 is a partial perspective view showing the dual motion mechanism and the movement of the elements corresponding to arm motion in one direction according to the present invention.
Figure 7:
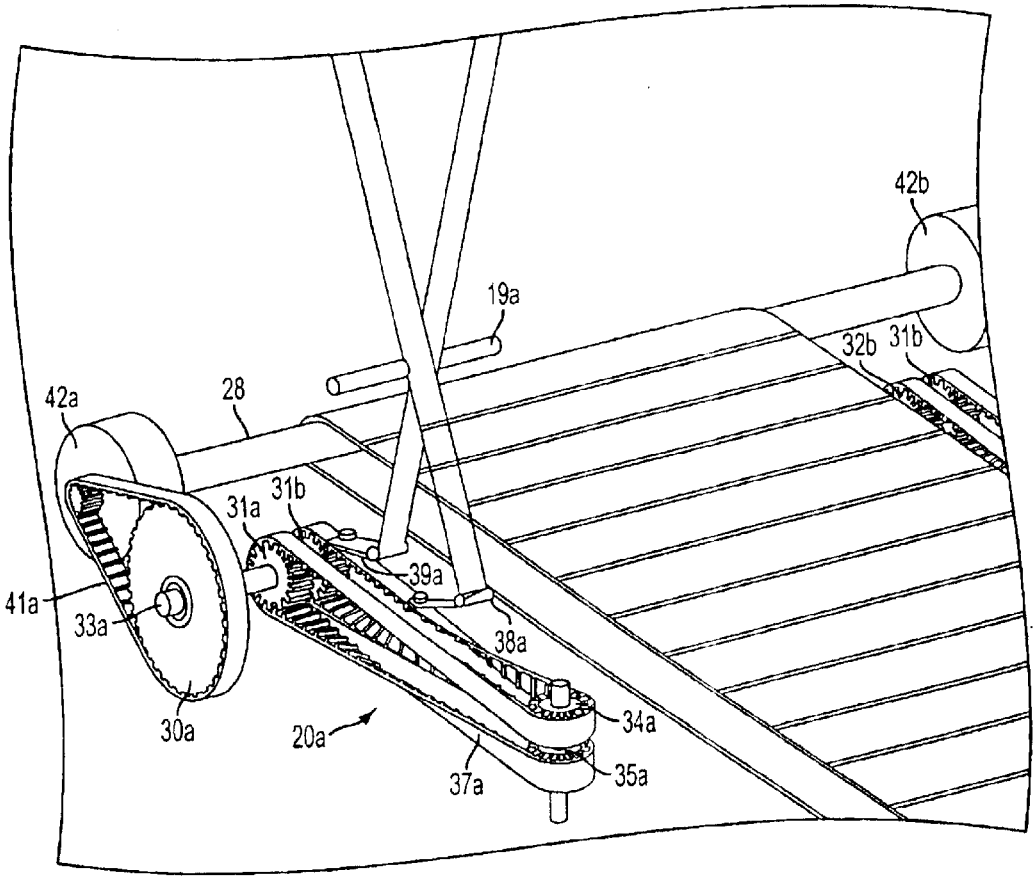
FIG. 7 is a partial perspective view showing the operation of the driver plate according to the present invention.

Referring to FIGS. 3 and 7, the operation of transmission system 20*a* is further illustrated. To appropriately drive double wound belt 37*a*, arm member 16*a* is operatively connected thereto by a driver plate 39*a*, using a driver plate bolt 40*a* which attaches plate 39*a* to double wound belt 37*a*. A driver plate pivot 38*a* is defined at the point where the lower end of arm member 16*a* is rotatably linked to driver plate 39*a*. As specifically shown in FIG. 7, arm member 16*a* is illustrated in the reciprocating forward position (in phantom) and the rearward position (in solid) when driver plate 39*a* drives double wound belt 37*a*. In either the forward or rearward positions, drive plate 39*a* is lifted off double wound belt 37*a* at the end of plate 39*a* linked to arm member 16*a* while in between both forward and rearward positions at the end of plate 39*a* gradually falls back down against belt 37*a* as belt 37*a* is driven in a reciprocating motion by plate 39*a*.

Referring back to FIG. 3, double wound belt 37*a* is wound around freewheel pulleys 34*a* and 35*a* and around the clutches 31*a* and 32*a* in such a manner that movement of double wound belt 37*a* will cause freewheel pulleys 34*a* and 35*a* and clutches 31*a* and 32*a* to rotate in opposite directions relative to one another. Further, each pair of clutches 31*a* and 32*a*, and freewheel pulleys 34*a* and 35*a* are orientated such that their axes of rotation are perpendicular relative to the other. Therefore, in winding double wound belt 37*a* around clutches 31*a* and 32*a* and freewheel pulleys 34*a* and 35*a* during assembly, belt 37*a* has four separate rotations of 180 degrees.

To assemble, double wound belt 37*a* is wound around clutch 31*a* and then around freewheel pulley 34*a* such that belt 37*a* is rotated 180 degrees and reverses direction. Double wound belt 37*a* is then wound around second clutch 32*a*. Because double wound belt 37*a* has rotated 180 degrees around pulley 34*a* between its rotation around clutch 31*a* and clutch 32*a*, belt 37*a* imparts a rotation to clutch 31*a* in a direction opposite that of clutch 32*a*. In similar fashion, double wound belt 37*a* rotates 180 degrees as it is wound around freewheel pulley 35*a* and prior to being wound around clutch 31*a*. In an analogous manner, the rotation of double wound belt 37*a* 180 degrees around clutch 32*a* between its rotation around freewheel pulley 34*a* and freewheel pulley 35*a*, imparts a rotation to freewheel pulley 34*a* in a direction opposite of that in which belt 37*a* rotates freewheel pulley 35*a*.

In operation, moving the arm member 16*a* backward as indicated by the arrow 50 in FIG. 3, causes the lower part of the arm member 16*a* to move forward as shown by arrow 51. This forward movement is translated to the double wound belt 37*a* through the driver plate 39*a* as discussed above. Movement of the double wound belt 37*a* in the direction indicated by arrow 52 causes clutch 32*a* to spin in a counter-clockwise direction, as indicated by arrow 53. The movement of double wound belt 37*a* along transmission system 20*a* then causes freewheel pulley 35*a* to rotate in a clockwise direction as indicated by arrow 54. As the user continues to operate treadmill 10, double wound belt 37*a* moves in the direction indicated the arrow 55, which causes clutch 31*a* to spin in a clockwise direction, as indicated by arrow 56. As double wound belt 37*a* moves in the direction shown by arrow 57, belt 37*a* rotates freewheel pulley 34*a* in a counter-clockwise direction, as illustrated by arrow 58.

Figure 4:
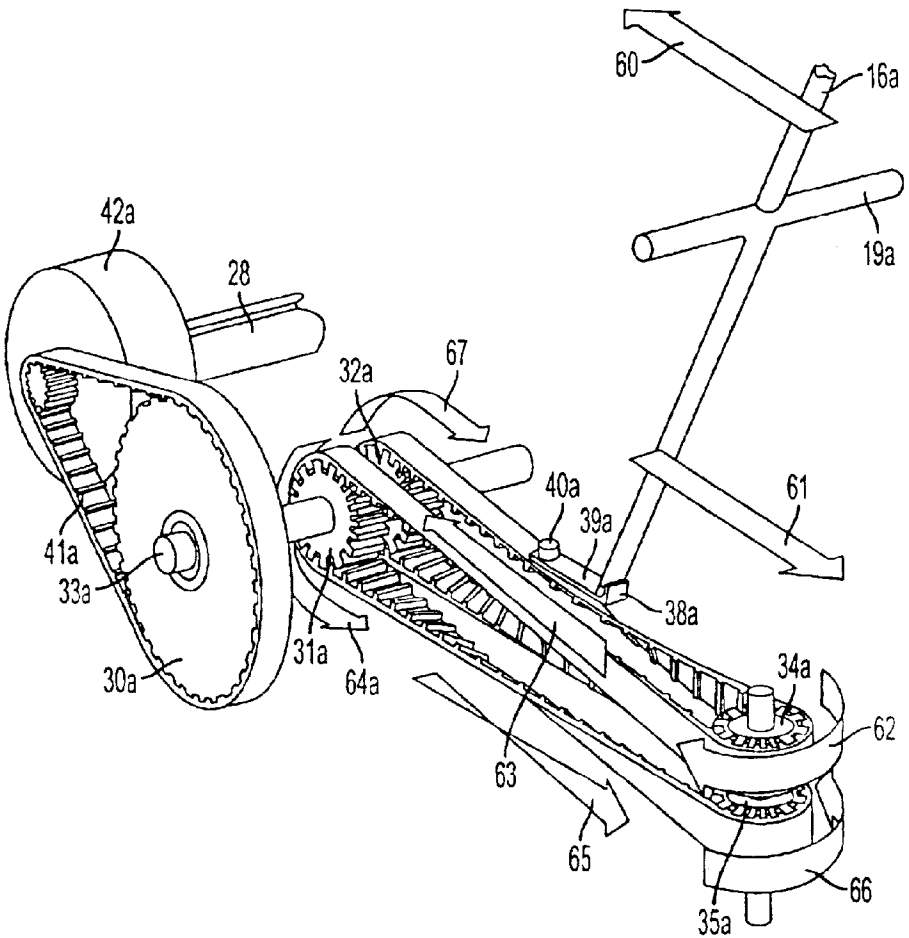
FIG. 4 is a partial perspective view showing the dual motion mechanism and the movement of the elements corresponding to arm motion in the direction opposite that shown in FIG. 3 according to the present invention.
Figure 5:
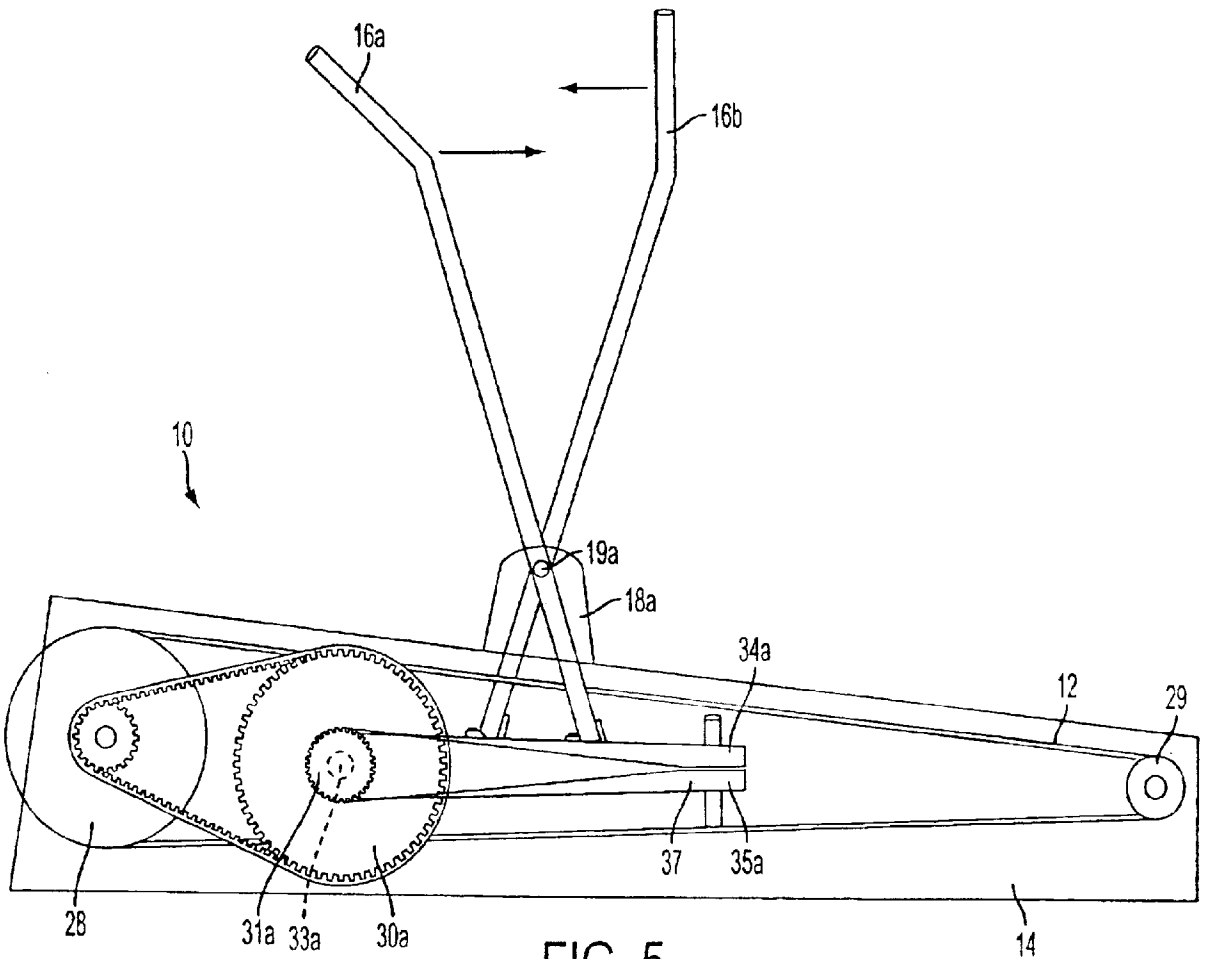
FIG. 5 is a side view of the treadmill according to the present invention.
Figure 6:
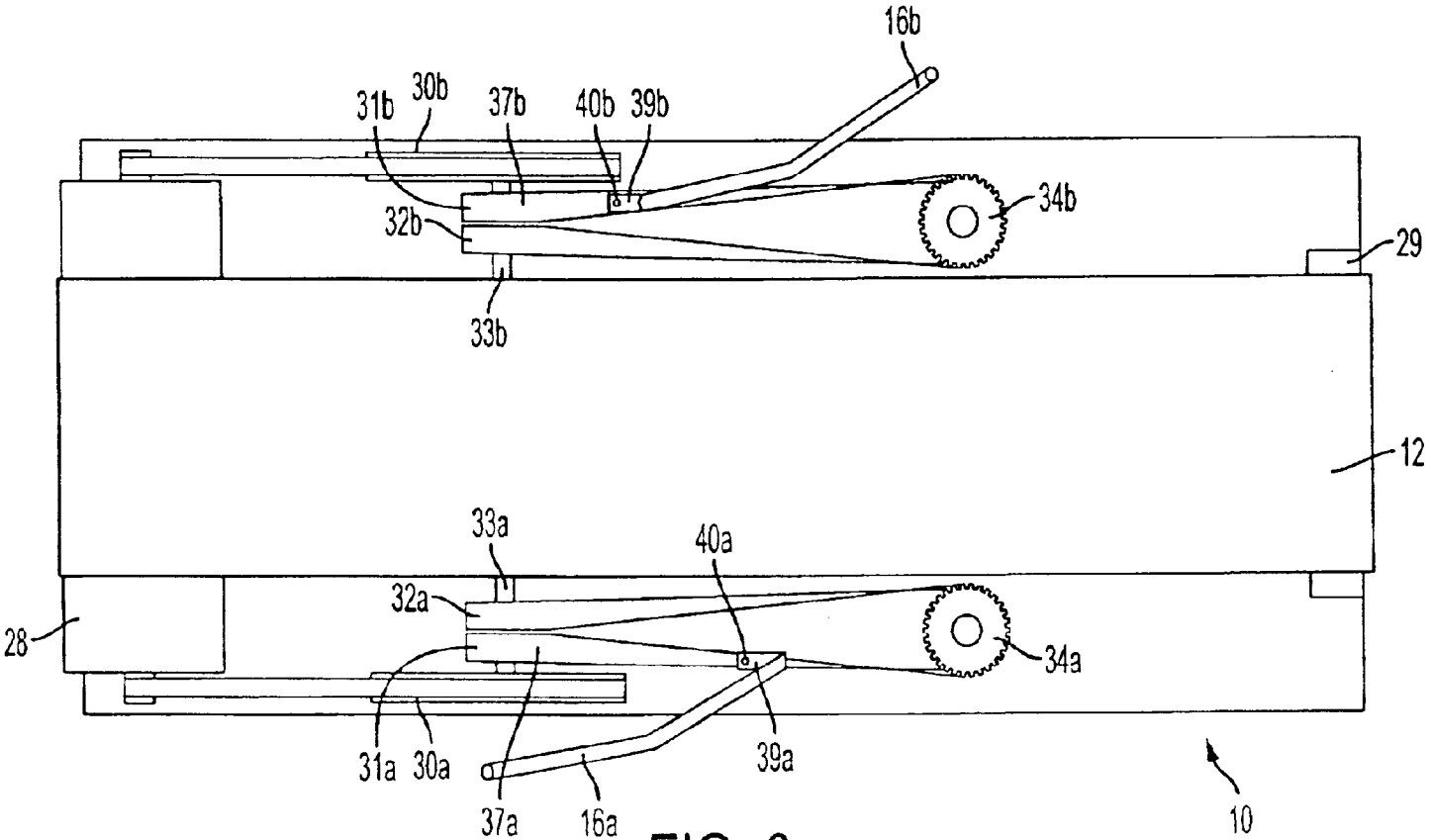
FIG. 6 is a top view of the treadmill according to the invention.

Conversely, pushing arm member 16*a* forward, away from the user, as shown by arrow 60 in FIG. 4, causes the lower part of arm member 16*a* to move backward as shown by arrow 61. As the lower part of arm member 16*a* moves backward, clutch 32*a* is forced to rotate in a clockwise direction shown by arrow 67. The movement of double wound belt 37*a* will also cause freewheel pulley 34*a* to spin in a clockwise direction shown by arrow 62. As double wound belt 37*a* moves in the direction of arrow 63, clutch 31*a* rotates in a counter-clockwise direction, as indicated by arrow 64. When double wound belt 37*a* moves in the direction of arrow 65, belt 37*a* causes freewheel pulley 35*a* to rotate in a counter-clockwise direction shown by arrow 66.

The underside of double wound belt 37*a* includes treads which interlock with the teeth of the two freewheeling pulleys 34*a* and 35*a* and with the respective teeth of clutches 31*a* and 32*a* such that the double wound belt 37*a* does not slip. Rotation of clutches 31*a* and 32*a* drives pulley 30*a* through common shaft 33*a*. In order that pulley 30*a* rotate in only one direction, clutches 31*a* and 32*a* are preferably one-way clutches, as will be described in greater detail below. Clutches of this type are commercially available from Torrington Corporation, Torrington, Conn. under Part No. RCB162117.

As shown in both FIGS. 3 and 4, movement of arm member 16*a* by the user causes clutches 31*a* and 32*a* to rotate in opposite directions relative to one another. To drive belt 12 of treadmill 10 in only the rearward direction, it requires that pulley 30*a* rotate in only one direction. One way clutches 31*a* and 32*a* are arranged in such a fashion that when clutch 31*a* rotates in a clockwise direction, as shown in FIG. 3, it rotates drive shaft 33*a* in the same clockwise direction. Conversely, when clutch 32*a* rotates in a counter-clockwise direction, clutch 32*a* only freewheels, and does not rotate drive shaft 33*a*.

In similar fashion, when clutch 32*a* rotates in a clockwise direction, illustrated in FIG. 4, it rotates drive shaft 33*a* in a clockwise direction. As clutch 32*a* rotates drive shaft 33*a*, clutch 31*a* rotates in a counter-clockwise direction and freewheels. In this manner, drive shaft 33*a* rotates in a clockwise direction when the user moves arm member 16*a* in a forward or backward direction. This arrangement allows the user to feel the resistance of his weight and the braking device (described in greater detail below) acting against the motion of belt 12 when moving arm members 16*a* and 16*b* in both a forward and backward direction which provides for a more even workout by the user. In addition, because each arm member 16*a* and 16*b* can drive belt 12 through either a forward and rearward motion, arm members 16*a* and 16*b* can be decoupled so that neither arm member 16*a* or 16*b* is required to move in unison with the other arm member 16*a* or 16*b*. This independent arrangement between arm members 32*a* and 32*b* also allows the user to move his arms at independent rates of one another in whichever fashion he finds most satisfying when exercising.

Preferably, treadmill 10 is inclined at a generally shallow angle relative to the horizontal plane such that the weight of the user supplements the force that is generated by the user's movement of arm members 16*a* and 16*b*. Of course, as previously described, the incline may be varied depending on the user's preference. Nevertheless, the present invention contemplates that the speed of the user's arm movement when moving arm members 16*a* and 16*b* corresponds to the speed of the user's stride, which is a factor used in determining the speed of belt 12 absent any belt 12 slippage. It should be understood that the ratio of the arm movement to belt travel is not solely a function of gear ratio, but is also determined by the force of the weight applied by the user in conjunction with the incline of treadmill 10. For example, with sufficient incline, belt 12 can move freely without any movement of arm member 16*a* and 16*b* as a result of the user's weight alone.

Based on the principle of the conservation of angular momentum, the mass and other dimensions of drive roller 28 makes roller 28 act as an energy storage means to make the rotation of belt 12 smooth during the transition from forward to rearward movement of arm members 16*a* and 16*b*. This is especially true in the embodiment illustrated in FIG. 2*b* where the transmission system 20 directly drives drive roller 28. Furthermore, in the embodiment shown in FIG. 2*a*, flywheel 42 stores rotational energy which further smoothes the rotation of belt 12. As shown in FIG. 2*a*, flywheel 42 includes a metallic disc, or the like, which rotates around an axis of rotation parallel to that of the pulleys 41*a* and 41*b*.

The ratio of the diameter of drive roller 28 to the diameters of the various clutches 31*a* and 32*a* and pulley 30*a* are such that a normal length stride by an average user corresponds to a normal amount of arm movement applied by the user. More particularly, the ratio of arm travel to belt travel is approximately 1 to 1, or substantially equal. The size of drive roller 28 can vary depending on whether a flywheel is used. As shown in FIG. 2*a*, with a flywheel present, drive roller 28 can be relatively small in diameter. However, in the alternative embodiment shown in FIG. 2*b*, absent a flywheel, drive roller 28 must have a larger diameter. The sizes of the pulley 30*a* and one-way clutches 31*a* and 32*a* can be varied so long as the appropriate ratio of arm motion to belt travel is obtained. As will be appreciated by one skilled in the art, the exact size of pulley 30*a* and one-way clutches 31*a* and 32*a* is irrelevant, as the only concern is the ratio of arm travel to belt travel.

Although not necessary to the operation of the present invention, a braking device may be added, if desired, to regulate the amount of arm force required to drive belt 12. An example of one such braking device is disclosed in U.S. Pat. No. 5,462,504, assigned to the assignee of the current application, which has been incorporated by reference.

As can be seen from the foregoing detailed description, a manual treadmill 10 exercises both the upper and lower body of a user. Further, the upper body can be evenly exercised by encountering substantially equal resistance throughout its range of motion or greater power emphasis can be applied by the user to one arm member as opposed to the other arm member. Belt 12 moves such that the stride of a user feels relatively natural, even as the user varies the speed of his stride. The present invention contemplates that the amount of upper body exercise can be varied relative to the amount of lower body exercise.

Although the preferred embodiment of transmission system 20 employs a belt-based, mechanical transmission mechanism, other non-motorized transmission mechanisms are contemplated by the present invention. For example, other suitable transmission mechanisms for converting bi-directional arm movement to belt rotation include, but are not limited to, a meshed gear arrangement or hydraulic, pneumatic, or electromagnetic based systems. Further, one-way clutches 31*a*, 31*b*, 32*a* and 32*b* can be implemented through valve based systems, or systems based on electromagnetic switching.

It should be understood from the foregoing that, while particular embodiments of the invention have been illustrated and described, various modifications can be made thereto without departing from the spirit and scope of the present invention. Therefore, it is not intended that the invention be limited by the specification; instead, the scope of the present invention is intended to be limited only by the appended claims.

We claim:

1. A treadmill for exercising the upper body and lower body of a user, comprising, a substantially stationary support frame, an endless belt longitudinally supported on the support frame, a pair of displaceable arm members disposed astride the endless belt, each of the arm members being displaceable forwardly and rearwardly relative to the frame by a reciprocating arm movement of the user, a drive roller coupled to the belt, and a transmission system linking the drive roller to the displaceable arm members such that displacement of one displaceable arm member causes the drive roller to rotate the belt but does not cause an equal magnitude displacement in any other displaceable arm member.

2. The treadmill of claim 1 wherein the transmission system comprises two transmission belts attached to two pulley systems and wherein each belt is attached to one displaceable arm member.

3. The treadmill of claim 2 wherein each pulley system comprises two freewheeling pulleys mounted on a common shaft and two one-way clutches mounted on another common shaft and orientated such that they engaged in the same rotational direction.

4. The treadmill of claim 3 wherein each transmission belt is a double wound belt, wound around the two one-way clutches and the two freewheeling pulleys such that translational motion of the belt causes the two one-way clutches to rotate in opposite rotational directions.

5. The treadmill of claim 1 wherein displacement of one displaceable arm member in either forward or rearward direction causes the belt to rotate rearwardly.

6. The treadmill of claim 1 wherein the transmission systems rotates the drive roller such that movement of the displaceable arm members corresponding to a user's arm movement rotates the endless belt a distance equivalent to the user's stride.

7. The treadmill of claim 1 wherein the transmission system includes a flywheel rotationally connected to the drive roller.

8. A treadmill for exercising the upper body and lower body of a user, comprising, a substantially stationary support frame, an endless belt longitudinally supported on the support frame, a pair of displaceable arm members disposed astride the endless belt, each of the arm members being displaceable forwardly and rearwardly relative to the frame by a reciprocating arm movement of the user, a drive roller coupled to the belt, and two independent transmission systems, each linking the drive roller to a displaceable arm member such that displacement of one displaceable arm member in either the forward or rearward direction causes the drive roller to rotate the belt in the rearward direction.

9. The treadmill of claim 8 wherein displacement of one displaceable arm member in either the forward or rearward direction does not cause the other displaceable arm member to be displaced by an equal magnitude.

10. The treadmill of claim 8 wherein each transmission system comprises a pulley system and a transmission belt connected to the pulley system.

11. The treadmill of claim 10 wherein the pulley system comprises two freewheeling pulleys mounted on a common shaft and two one-way clutches mounted on another common shaft and orientated such that they engage in the same rotational direction.

12. The treadmill of claim 11 wherein the transmission belt is a double wound belt, wound around the two one-way clutches and the two freewheeling pulleys such that translational motion of the belt causes the two one-way clutches to rotate in opposite rotational directions.

13. The treadmill of claim 8 wherein the transmission system rotates the drive roller such that a user's arm movement is substantially equivalent to the user's stride.

14. A method of assisting the rotation of a treadmill belt comprising the steps of: inclining the front end of the belt such that gravitational force of a user frictionally coupled to the belt urges the belt rearwardly; and transferring kinetic energy generated by both forward and rearward movements of each arm of a user directly to rearward movement of the belt to assist the gravitationally induced rearward movement of the belt.

15. The method of claim 14 wherein the transfer of kinetic energy generated by both forward and rearward movements of each arm of a user is such that the rearward movement of the belt generated by the arm movements is substantially equivalent to the stride to the user.

16. The method of claim 14 wherein each arm can independently transfer kinetic energy to the treadmill belt through the arm's motion in both the forward and rearward directions without movement of the other arm.

17. The method of claim 14 wherein the transferring of kinetic energy occurs through the use of a pulley system comprising two one-way clutches and a double wound belt.

18. The method of claim 17 wherein movement of the double wound belt causes the two one-way clutches to rotate in opposite rotational directions such that only one one-way clutch is transferring the kinetic energy to the rearward movement of the belt.

* * * * *